US011110453B2

(12) United States Patent
Govyadinov et al.

(10) Patent No.: US 11,110,453 B2
(45) **Date of Patent: *Sep. 7, 2021**

(54) MICROFLUIDIC DEVICES

(71) Applicant: Hewlett-Packard Development Company, L.P., Spring, TX (US)

(72) Inventors: Alexander Govyadinov, Corvallis, OR (US); Adam Higgins, Corvallis, OR (US); Pavel Kornilovich, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 232 days.

This patent is subject to a terminal disclaimer.

(21) Appl. No.: 16/492,334

(22) PCT Filed: Apr. 7, 2017

(86) PCT No.: PCT/US2017/026551

§ 371 (c)(1),
(2) Date: Sep. 9, 2019

(87) PCT Pub. No.: WO2018/186880

PCT Pub. Date: Oct. 11, 2018

(65) Prior Publication Data

US 2020/0406258 A1 Dec. 31, 2020

(51) Int. Cl.
*B01L 3/00* (2006.01)

(52) U.S. Cl.
CPC . *B01L 3/502723* (2013.01); *B01L 2200/0684* (2013.01); *B01L 2300/0883* (2013.01); *B01L 2400/0688* (2013.01)

(58) Field of Classification Search
CPC ..... B01L 2200/0684; B01L 2300/0816; B01L 2300/0883; B01L 2400/0688; B01L 3/502723
See application file for complete search history.

(56) References Cited

U.S. PATENT DOCUMENTS 7,999,937 B1 8/2011 Srivastava et al.
8,337,777 B2 12/2012 Nurse et al.
(Continued)

FOREIGN PATENT DOCUMENTS

TW 201639773 11/2016
WO 2005060432 7/2005
(Continued)

OTHER PUBLICATIONS

Lochovsky et al., Bubbles No More: Trapping and Removal of Gas Bubbles in Single-Layer Elastomeric Devices, 4th International Conference on Miniaturized Systems for Chemistry and Life Sciences, Oct. 3-7, 2010, pp. 1805-1807.
(Continued)

*Primary Examiner* — Jennifer Wecker
*Assistant Examiner* — Jonathan Bortoli
(74) *Attorney, Agent, or Firm* — Thorpe North & Western LLP

(57) ABSTRACT

The present disclosure is drawn to microfluidic devices. In one example, a microfluidic device can include a microfluidic channel. A vent chamber can be in fluid communication with the microfluidic channel. A capillary break can be located between the microfluidic channel and the vent chamber. The capillary break can include a tapered portion and a narrowed opening with a smaller width than a width of the microfluidic channel. A vent port can vent gas from the vent chamber. The vent port can be located a distance away from the capillary break so that a fluid in the capillary break does not escape through the vent port.

15 Claims, 12 Drawing Sheets

(56) References Cited

U.S. PATENT DOCUMENTS

| | | | | |
|---|---|---|---|---|
| 8,597,590 | B2 * | 12/2013 | Yue | B01L 3/502723 422/402 |
| 9,492,820 | B2 | 11/2016 | Reed et al. | |
| 9,555,408 | B2 | 1/2017 | Tan et al. | |
| 2002/0166592 | A1 | 11/2002 | Liu et al. | |
| 2011/0066108 | A1 | 3/2011 | Geipel et al. | |

FOREIGN PATENT DOCUMENTS

| | | | | |
|---|---|---|---|---|
| WO | 2012094459 | | 7/2012 | |
| WO | 2016029200 | | 2/2016 | |
| WO | WO-2016137490 | A1 * | 9/2016 | B41J 2/1404 |

OTHER PUBLICATIONS

International Search Report dated Dec. 21, 2017 for PCT/US2017/026551, Applicant Hewlett-Packard Development Company, L.P.

* cited by examiner

MICROFLUIDIC DEVICES

BACKGROUND

Microfluidics relates to the behavior, precise control and manipulation of fluids that are geometrically constrained to a small, typically sub-millimeter, scale. Numerous applications employ passive fluid control techniques such as capillary forces. In some applications, external actuation techniques are employed for a directed transport of fluid. A variety of applications for microfluidics exist, with various applications requiring differing controls over fluid flow, mixing, temperature, evaporation, and so on.

BRIEF DESCRIPTION OF THE DRAWINGS

Additional features and advantages of the disclosure will be apparent from the detailed description which follows, taken in conjunction with the accompanying drawings, which together illustrate, by way of example, features of the present technology.

Figure 1:
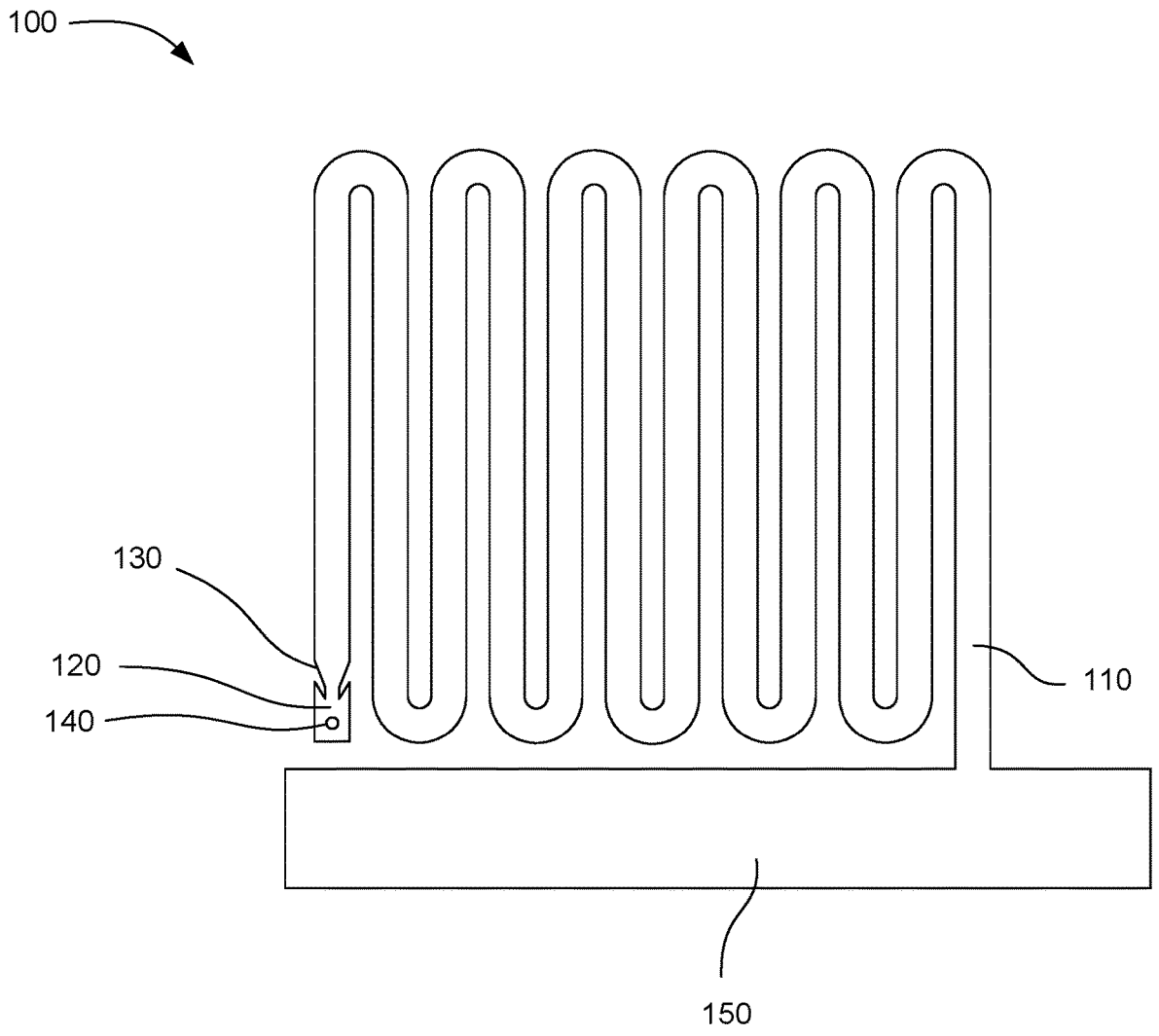
FIG. 1 is a schematic view of an example microfluidic device in accordance with the present disclosure.

Reference will now be made to several examples that are illustrated herein, and specific language will be used herein to describe the same. It will nevertheless be understood that no limitation of the scope of the disclosure is thereby intended.

DETAILED DESCRIPTION

The present disclosure is drawn to microfluidic devices. The microfluidic devices described herein can include a microfluidic channel, a vent chamber in fluid communication with the microfluidic channel, a capillary break between the microfluidic channel and the vent chamber, and a vent port to vent gas from the vent chamber. The capillary break can include a tapered portion and a narrowed opening with a smaller width than a width of the microfluidic channel. The vent port can be located a distance away from the capillary break so that fluid in the capillary break does not escape through the vent port.

In particular example, the capillary break can have a narrowed opening width from about 2 μm to about 20 μm.

In further examples, the capillary break can be one of a plurality of capillary breaks connected in series between the microfluidic channel and the vent chamber. In one such example, the microfluidic channel can be separated from the vent chamber by three or more capillary breaks connected in series. In another example, the capillary breaks can have different narrowed opening widths decreasing in the direction toward the vent chamber.

In a further example, the microfluidic channel can be one of a plurality of microfluidic channels. The plurality of microfluidic channels can be in fluid communication with the vent chamber through a plurality of capillary breaks.

In another example, the microfluidic device can also include a vent conduit separating the vent port from the vent chamber. The vent conduit can have a width smaller than a width of the microfluidic channel. In yet another example, the vent conduit can include one or more turns. In a particular example, the vent port can have a diameter from about 2 μm to about 20 μm.

In other examples, the microfluidic channel can be formed as a loop having a turn with the capillary break connection the microfluidic channel at the turn to the vent chamber.

In additional examples, a microfluidic nucleic acid testing device can include a fluid feed opening, a microfluidic channel in fluid communication with the fluid feed opening, a vent chamber in fluid communication with the microfluidic channel, a heating resistor located proximate to the microfluidic channel, a capillary break between the microfluidic channel and the vent chamber, and a vent port to vent gas from the vent chamber. The capillary break can include a tapered portion and a narrowed opening with a smaller width than a width of the microfluidic channel. The vent port can be located at a distance away from the capillary break so that a fluid in the capillary break does not escape through the vent port. The heating resistor can be capable of heating a fluid in the microfluidic channel.

In a further example, the microfluidic nucleic acid testing device can also include a temperature sensor located proximate to the microfluidic channel. The temperature sensor can be capable of measuring a temperature of a fluid in the microfluidic channel. In another example, the microfluidic channel can be capable of self-priming by capillary force.

In additional examples, a microfluidic device can include a covered fluid feed slot, a plurality of microfluidic channels formed as loops connecting to the covered fluid feed slot at both ends, inertial pumps in the microfluidic channels, a vent chamber in fluid communication with the plurality of microfluidic channels, a plurality of capillary breaks between the plurality of microfluidic channels and the vent chamber, and a vent port to vent gas from the vent chamber. The capillary breaks can include a tapered portion and a narrowed opening with a smaller width than a width of the microfluidic channels. The vent port can be located a distance away from the capillary breaks so that fluid in the capillary breaks does not escape through the vent port. The covered fluid feed slot can include a fluid feed hole for filling a fluid into the covered fluid feed slot. The fluid feed hole can have a smaller area than the covered fluid feed slot. The inertial pumps can circulate the fluid through the microfluidic channels. In a particular example, each microfluidic channel can be separated from the vent chamber by three or more capillary breaks connected in series.

The microfluidic devices described herein can provide reduced evaporation of fluid in microfluidic channels, eliminate air bubbles trapped in the microfluidic channels, and improve priming of the microfluidic channels in the microfluidic devices. Nucleic acid testing is one example of an area in which these features can be useful. Nucleic acid tests, such as nucleic acid amplification tests, polymerase chain reaction (PCR) tests, and other nucleic acid tests, can often be performed with small volumes of sample fluid. Thus, the microfluidic devices described herein, with their small internal fluid volumes, can be useful for testing these small sample volumes. The reduced evaporation provided by the microfluidic devices can be especially useful to ensure that the sample does not evaporate too quickly before a test can be completed. Additionally, some types of nucleic acid tests involve heating the sample fluid to elevated temperatures. If air bubbles are present in the microfluidic channels, then the heating can cause the air bubble to expand, potentially blowing out the sample fluid from the microfluidic channels or even damaging the microfluidic device. The devices described herein can reduce the occurrence of air bubbles in the microfluidic channels. This can make the devices more reliable for many applications, and especially for applications involving heating of the sample fluid.

In further examples, the microfluidic devices described herein can be used for testing a variety of bio-chemical targets. In certain examples, the microfluidic devices can include multiple adjacent microfluidic channels to test multiple fluids simultaneously. In some cases, adjacent microfluidic channels can be used to test a sample in one of the microfluidic channels and a reference reaction in an adjacent microfluidic channel. For example, a sample fluid to be tested for a target compound can be reacted with reagents in one microfluidic channel while a control fluid, or "placebo" that is known not to contain the target compound, can be mixed with the same reagents in the adjacent microfluidic channel. The reactions occurring in each microfluidic channel can be compared to determine whether the sample fluid contains the target. For example, if the sample fluid contains the target compound then the first microfluidic channel can produce a positive signal while the adjacent microfluidic with the control fluid produces no signal. This can reduce signal-to-noise ratio in the test and increase the test sensitivity. In another example, the sample fluid can be compared to a reference fluid that has a known concentration of the target compound. In some examples, the device can have multiple microfluidic channels that can be loaded with multiple test samples, control fluids containing no target compound, and reference fluids containing a known concentration of target compound. This can provide a robust test with reduced likelihood of false positives and false negatives.

Non-limiting examples of tests that can be performed using the microfluidic devices described herein can include enzyme-linked immunoabsorbent assay (ELISA) immunoassay testing, nucleic acid amplification testing (NAAT) using polymerase chain reaction (PCR), isothermal amplification such as multiple displacement amplification (MDA), loop-mediated isothermal amplification (LAMP), rolling circle amplification (RCA), helicase-dependent amplification (HAD), recombinase polymerase amplification (RPA), nucleic acid sequence-based amplification (NASBA), hematology testing, and so on. A variety of other biochemical and non-biochemical tests can also benefit from the reduced evaporation and enhance priming of the microfluidic channels provided by the microfluidic devices described herein.

FIG. 1 shows an example of a microfluidic device 100 in accordance with the present disclosure. The device can include a microfluidic channel 110 and a vent chamber 120 in fluid communication with the microfluidic channel. A capillary break 130 can be between the microfluidic channel and the vent chamber. The capillary break can include a tapered portion and a narrowed opening with a smaller width than a width of the microfluidic channel. A vent port 140 can vent gas from the vent chamber. The vent port can vent gas from the vent chamber, and the vent port can be located a distance away from the capillary break such that fluid in the capillary break does not escape through the vent port. A fluid feed opening 150 can be used to feed fluid into the microfluidic channel. Although not shown in FIG. 1, in some examples the microfluidic channel, capillary break, and vent chamber can be open volumes formed within a solid material. The vent port and fluid feed opening can be openings in the solid material that allow fluid or gas to pass in and out of the device. The devices described herein can be fabricated by a variety of methods described in more detail below.

The microfluidic devices according to the present technology can include capillary breaks between the microfluidic channel and the vent chamber to stop fluid in the microfluidic channels from reaching the vent port. As used herein, a "capillary break" refers to a microfluidic structure that includes a tapered portion and a narrowed opening, in which the capillary force holding fluid in the narrowed opening can be increased with respect to the capillary force in the microfluidic channels. Thus, the capillary breaks can taper to a narrowed opening that has a smaller width than the width of the microfluidic channel.

Figure 2:
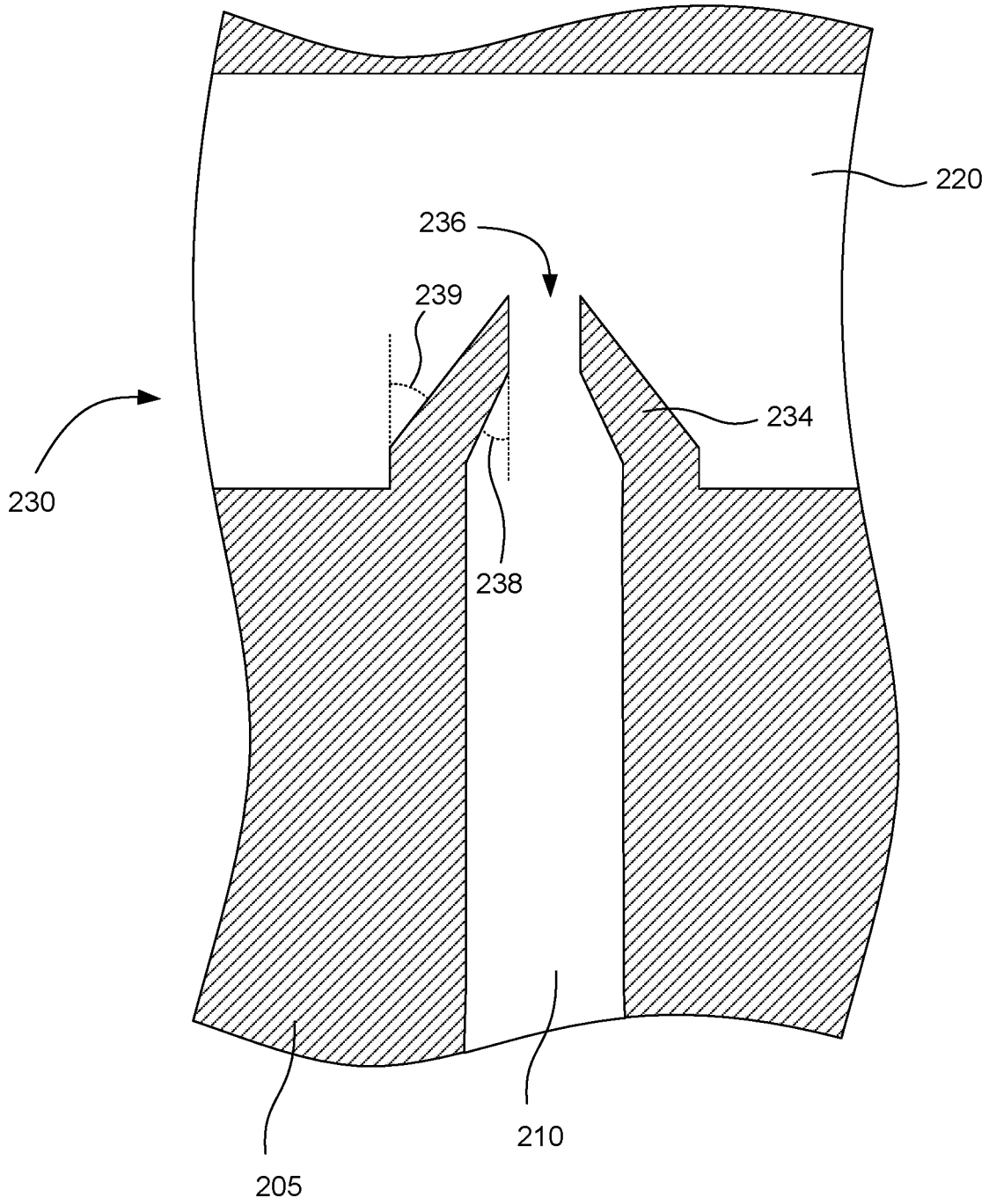
FIG. 2 is a top cross-sectional view of a capillary break in accordance with the present disclosure.

FIG. 2 shows one example of a capillary break 230 that can be used in the present microfluidic devices. The capillary break can include a tapered portion 234 and a narrowed opening 236. In this example, the capillary break can begin at the width of the microfluidic channel 210 and taper to the narrowed opening. The narrowed opening can extend into the vent chamber 220. When the microfluidic channel is primed with fluid, the fluid can flow into the narrowed opening of the capillary break and form a meniscus. The narrowed opening can have a smaller width than the microfluidic channel, and also a smaller width compared to the interior of the vent chamber. This can cause the capillary force to be greatest in the narrowed opening, which can tend to retain the fluid in the narrowed opening. The amount of force necessary to break the meniscus and force fluid to flow through the capillary break can also be increased by using a sharp angle between the narrowed opening and the exterior tapered portion in the vent chamber. In this example, the interior tapering angle 238 and exterior tapering angle 239 are shown in dashed lines. In some examples, the interior tapering angle and exterior tapering angle can independently be from about 5° to about 45°. In further examples, the narrowed opening can have a width that is from 1% to 90% the width of the microfluidic channel. In more specific examples, the narrowed opening can have a width that is from 2% to 60% or from 5% to 40% the width of the microfluidic channel. In one example, the narrowed opening can have a width from about 2 μm to about 20 μm. As shown in this figure, the microfluidic channel, capillary break, and vent chamber can be formed in a solid material 205. The solid material can form the walls of the microfluidic channel and vent chamber, as well as the tapering portion of the capillary break. The narrowed opening of the capillary break can be a void space between the solid material of the tapering portion on either side of the capillary break.

Figure 3:
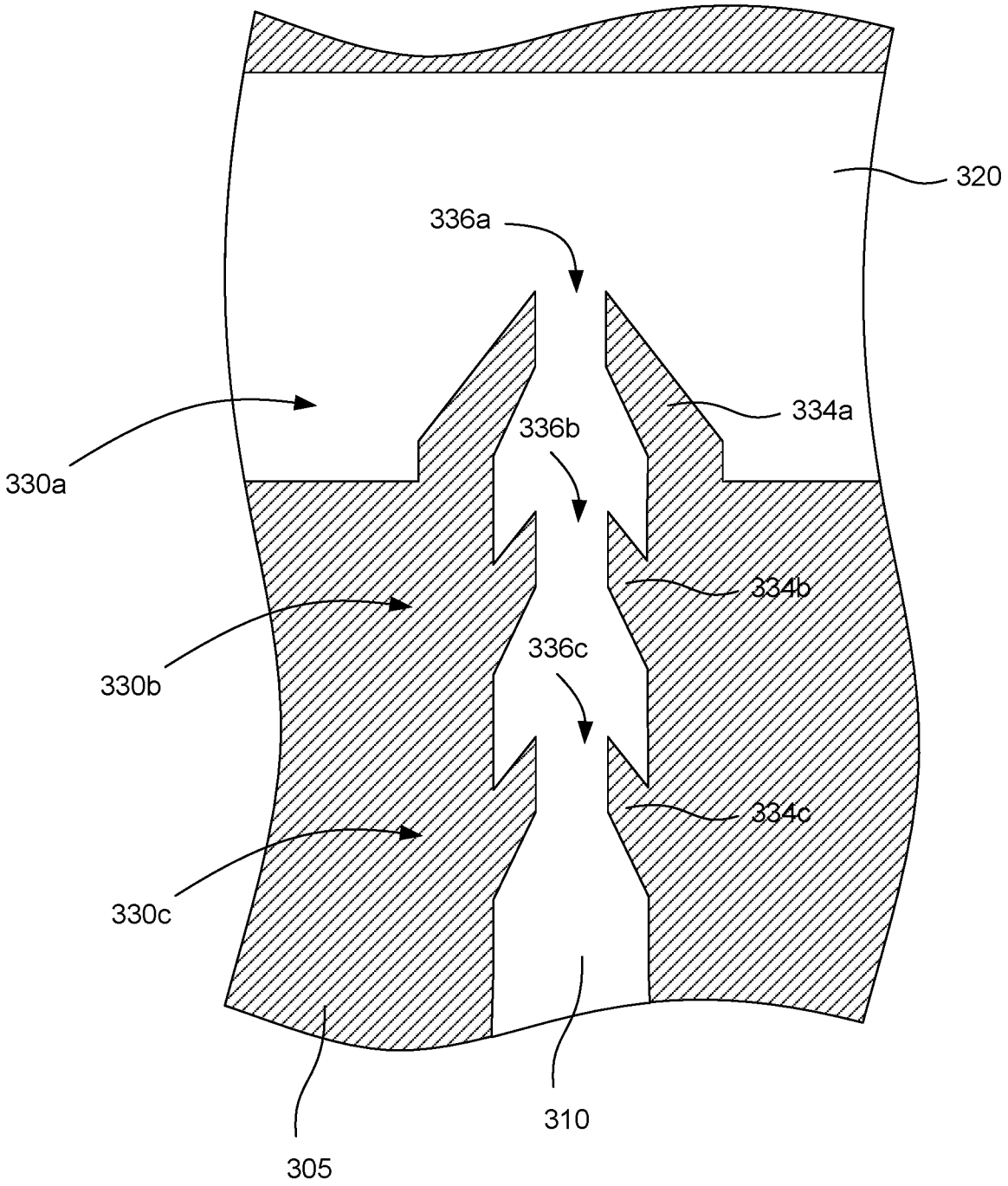
FIG. 3 is a top cross-sectional view of a series of capillary breaks in accordance with the present disclosure.

In certain further examples, multiple capillary breaks can be used in series between a microfluidic channel and a vent chamber. In some cases, three or more capillary breaks can be placed in series. FIG. 3 shows an example of three capillary breaks 330*a*, 330*b*, 330*c* placed in series between a microfluidic channel 310 and a vent chamber 320. The capillary breaks can include tapering portions 334*a*, 334*b*,

334*c* and narrowed openings 336*a*, 336*b*, 336*c*. The walls of the microfluidic channel and vent chamber, as well as the tapering portions of the capillary breaks, can be formed of solid material 305.

In various examples, the narrowed openings of the multiple capillary breaks can have the same narrowed opening width or different narrowed opening widths. In certain examples, the narrowed openings of the capillary breaks can have narrowed opening widths that decrease in the direction toward the vent chamber. Using multiple capillary breaks in series, whether with the same or different narrowed opening widths, can improve the reliability of the microfluidic device. As mentioned above, in some examples the capillary breaks can prevent fluid from flowing through the capillary breaks into the vent chamber. Using multiple capillary breaks in series can reduce the likelihood that unwanted fluid flow into the vent chamber will occur due to failure of a capillary break. In some examples, a capillary break can potentially fail to stop fluid flow due to a defect in manufacture of the capillary break, excessive pressure upstream of the capillary break causing the meniscus to break, or some other reason that a meniscus fails to form in the capillary break. When multiple capillary breaks can be used in series, the likelihood that all of the capillary breaks will fail to stop the fluid flow can be reduced. It is to be understood that any examples described herein can employ single capillary breaks or multiple capillary breaks in series, whether single or multiple capillary breaks are specifically described or shown in the figures.

In further examples of the present technology, the microfluidic channels can lead to vent chambers that can be in fluid connection with vent ports. The vent ports can facilitate priming of the microfluidic channels by allowing air in the microfluidic channels to escape when fluid enters the microfluidic channels. In various examples, the size and number of vent ports can be minimized to reduce evaporation of fluid through the vent ports.

In certain examples, the vent port can have a width smaller than a width of the microfluidic channels. For example, the vent port can have a width from 1 μm to 50 μm, 2 μm to 30 μm, or 5 μm to 20 μm in some cases. In further examples, the vent port can have a width that is from 1% to 99% the width of the microfluidic channels, 5% to 50% the width of the microfluidic channels, or 5% to 25% the width of the microfluidic channels. The shape of the vent port is not particularly limited. In some examples, the vent port can be circular, square, rectangular, or another shape.

The number of vent ports included in a microfluidic device can be reduced by connecting multiple microfluidic channels to a single vent chamber with a single vent port. In this way, a number of microfluidic channels full of fluid can be primed, allowing the air in the microfluidic channels to escape through the vent port. Then, evaporation in the microfluidic channels can be reduced because only the single vent port is available as a path for evaporation. Such a microfluidic device can have reduced evaporation compared to a device in which each microfluidic channel has its own vent port.

In another example, the number of vent ports can be reduced by using a vent port at the end of a long microfluidic channel. In certain examples, using a serpentine shaped microfluidic channel with a plurality of turns can allow a long microfluidic channel to occupy a small area. In one example, a single vent port can be formed at the end of a long serpentine microfluidic channel.

In further examples, a ratio of the number of vent ports in the microfluidic device to the total volume of fluid in the microfluidic channels can be from 1 vent port per 1 nL to 1 vent port per 100 nL. In certain examples, the microfluidic device can have as few as one vent per fluid feed opening.

Figure 4:
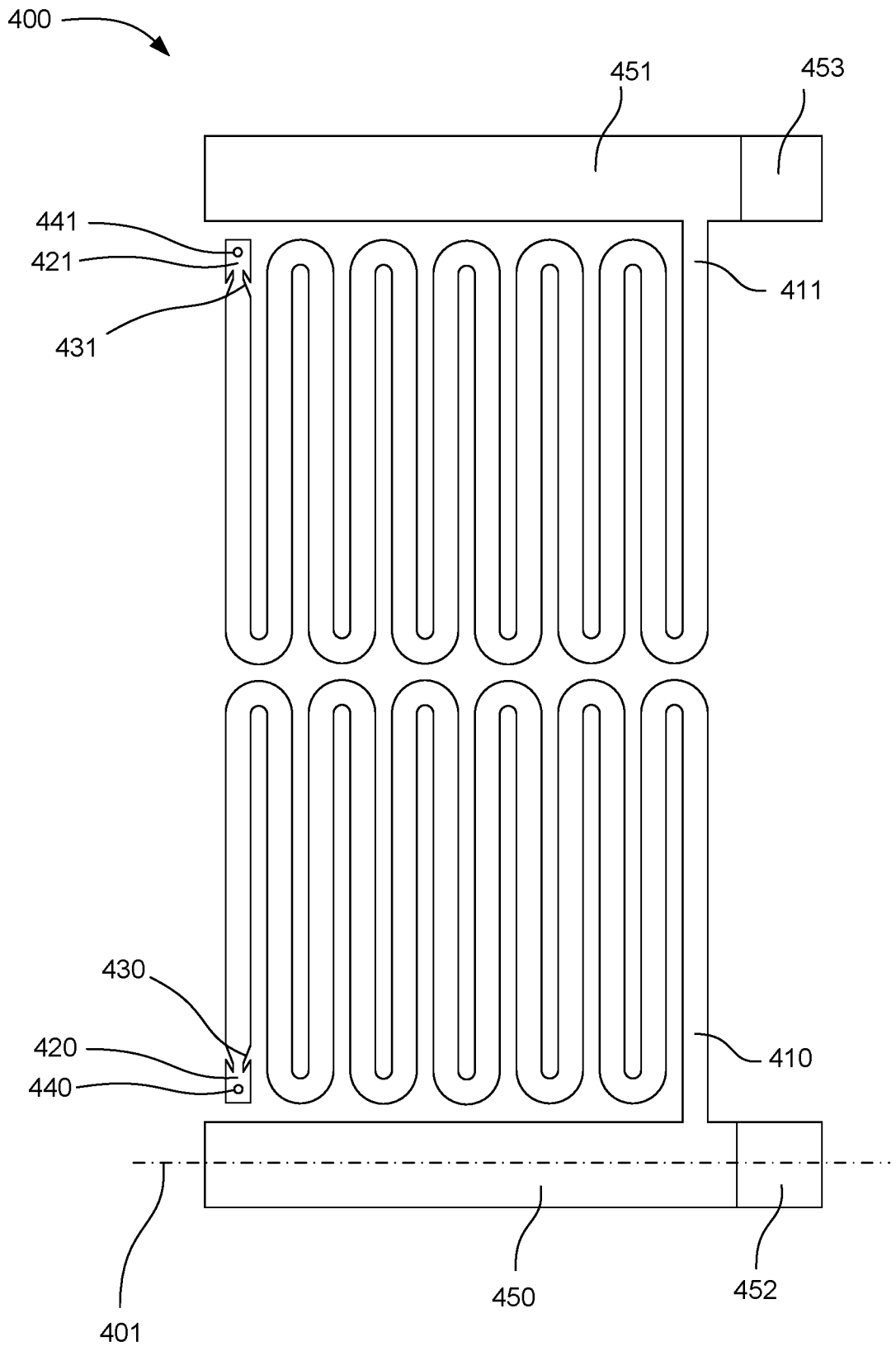
FIG. 4 is a schematic view of an example microfluidic device in accordance with the present disclosure
Figure 5:
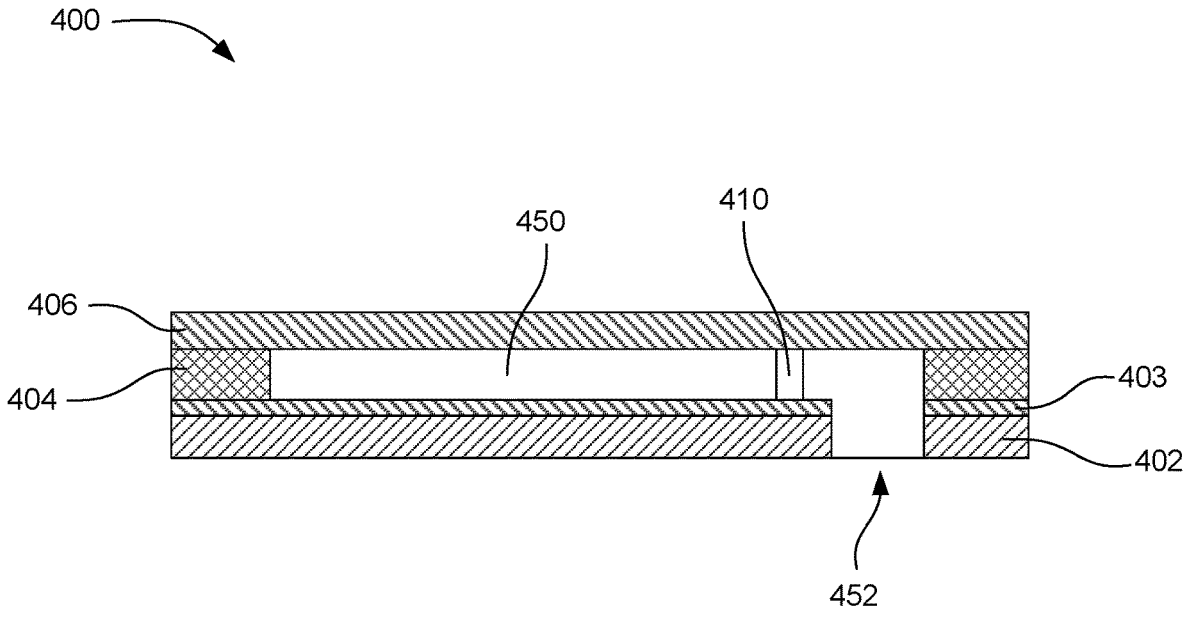
FIG. 5 is a side cross-sectional view of the example microfluidic device of FIG. 4.

FIG. 4 shows another example of a microfluidic device 400 that includes additional features. This particular example can include two fluid feed openings in the form of a first covered fluid feed slot 450 and a second covered fluid feed slot 451 with a first fluid feed hole 452 and a second fluid feed hole 453 to introduce fluid into the covered fluid feed slots. This example can also include a first microfluidic channel 410 and a second microfluidic channel 411. The first and second microfluidic channels can lead to first and second capillary breaks 430, 431. The capillary breaks can prevent fluid from entering first and second vent chambers 420, 421 and escaping through first and second vent ports 440, 441. To further clarify the structure of the covered fluid feed slots and fluid feed holes, a cross sectional view of the device as cut along dashed line 401 is shown in FIG. 5.

In some examples, the microfluidic device can include two microfluidic channels as shown in FIG. 4. The first microfluidic channel can be formed adjacent to the second microfluidic channel but not in fluid communication with the second microfluidic channel. Each of the microfluidic channels can be in fluid communication with a covered fluid feed slot having a fluid feed hole for introducing fluid into the covered fluid feed slot. In some cases, the fluid feed holes can have a smaller area than the covered fluid feed slots as viewed from above.

In some examples, the microfluidic device can include a substrate (not shown in FIG. 4) on top of which the covered fluid feed slots and microfluidic channels may be located. In certain examples, the fluid feed holes can be openings in the substrate. Fluid can be introduced into the covered fluid feed slots from beneath the device using these openings in the substrate. A majority of the covered fluid feed slot can be covered from below by the substrate. Thus, in some examples the amount of evaporation occurring through the substrate can be reduced because evaporation only occurs through the smaller fluid feed holes.

The microfluidic device can also include a top layer (not shown in FIG. 4) that covers the microfluidic channels and the covered fluid feed slots from above. In further examples, the fluid feed holes can be an opening in this top layer, allowing fluid to be filled into the covered fluid feed slots. Because the majority of the covered fluid feed slot can be covered by the top layer, evaporation from the covered fluid feed slot can only occur through the fluid feed hole. Other evaporation can potentially occur through the capillary breaks, vent chambers, and vent ports, but this can also be minimized by using small vent ports that can be few in number. Thus, using a fluid feed hole with a smaller area than the covered fluid feed slot can greatly reduce the amount of evaporation compared to a fluid feed slot that is open on the top. Accordingly, fluid feed holes can be formed in the top layer and/or in the substrate, with the top layer and substrate covering the covered fluid feed slots above and below, respectively. In particular, in some examples the entire area of the covered fluid feed slots can be covered above and below with the exception of the fluid feed holes.

Although the example fluid feed holes have been described above as having an area smaller than the area of the covered fluid feed slots, in some examples the fluid feed holes can have the same area as the covered fluid feed slots. In other words, in some examples the entire covered fluid feed slot can be open through either the substrate or the top layer. In certain examples, the microfluidic device can be a part of a larger system that includes a fluid delivery system to deliver fluid to the fluid feed holes. In such examples, the fluid delivery system can form a seal with the fluid feed holes so that evaporation at the fluid feed holes may not be an issue. In further examples, the fluid delivery system can be designed to reduce evaporation elsewhere in the fluid delivery system. In still further examples, smaller fluid feed holes can be used even when used together with such a sealed fluid delivery system. Although the smaller fluid feed holes may not affect evaporation in such examples, the smaller fluid feed holes can also provide the advantage of uniformly and sequentially priming microfluidic channels along the covered fluid feed slots. In such examples, fluid can enter the covered fluid feed slot at the fluid feed hole. The fluid can then flow along the covered fluid feed slot, sequentially priming each microfluidic channel as the fluid reaches the channels.

To clarify the structure of the covered fluid feed slots and fluid feed holes, FIG. 5 shows a side cross sectional view of the example device 400 shown in FIG. 4, viewing the device as cut along plane 401 through the center of the first covered fluid feed slot. In this particular example, the device can be formed with a substrate 402, a primer layer 403, a microfluidic layer 404 defining the walls of the covered fluid feed slots and microfluidic channels, and a top layer 406 covering the microfluidic layer. The first fluid feed hole 452 can be an opening through the substrate and primer layer. FIG. 5 shows the first covered fluid feed slot 450 covered by the top layer. An opening in the side wall of the first covered fluid feed slot can lead to the first microfluidic channel 410.

The microfluidic devices described are not limited to being formed by any particular process. However, in some examples, any of the microfluidic devices described herein can be formed from multiple layers as shown in FIG. 5.

In certain examples, the one or more of the layers can be formed photolithographically using a photoresist. In one such example, the layers can be formed from an epoxy-based photoresist, such as SU-8 or SU-8 2000 photoresist, which are epoxy-based negative photoresists. Specifically, SU-8 and SU-8 200 are Bisphenol A Novolac epoxy-based photoresists that are available from various sources, including MicroChem Corp. These materials can be exposed to UV light to become crosslinked, while portions that are unexposed can remain soluble in a solvent and can be washed away to leave voids.

In some examples, the substrate can be formed of a silicon material. For example, the substrate can be formed of single crystalline silicon, polycrystalline silicon, gallium arsenide, glass, silica, ceramics or a semiconducting material. In a particular example, the substrate can have a thickness from about 500 μm to about 1200 μm. In certain examples, the fluid feed holes can be formed in the silicon substrate by laser machining and/or chemical etching.

In further examples, the primer layer can be a layer of a photoresist material, such as SU-8, with a thickness from about 2 μm to about 100 μm.

In certain examples, the microfluidic layer can be formed by exposing a layer of photoresist with a pattern of walls to define the covered fluid feed slots and microfluidic channels, and then washing away the unexposed photoresist. In some examples, the microfluidic layer can have a thickness from about 2 μm to 100 μm. The microfluidic channels can be formed having a width from about 2 μm to about 100 μm, from about 10 μm to about 50 μm, or from about 20 μm to about 35 μm.

In certain examples, the top layer can be formed by laminating a dry film photoresist over the microfluidic layer and exposing the dry film photoresist with a UV pattern defining the fluid feed holes. In other examples, the fluid feed holes can be openings in the substrate, and the top layer can be substantially solid without any openings for fluid feed holes. The top layer can have a thickness from about 2 μm to about 200 μm. In still further examples, the vent ports can be openings in the top layer. In alternative examples, the vent ports can be openings in the substrate.

In some cases, using lamination of a dry photoresist layer to form the top layer of the device can allow for the use of a single vent port with multiple microfluidic channels, or very long microfluidic channels as described above. Some other methods of forming the top layer, such as using a lost wax method, can require additional ports in the top layer. For example, in a lost wax method, the microfluidic channels can be filled with a wax before applying the top layer. The wax can then be removed from the microfluidic channels. However, in some cases wax can be removed only up to a finite distance away from a port. Therefore, multiple ports in the top layer may be used so that all of the wax can be removed. However, these ports can also increase the amount of fluid evaporation when the device is in use. By laminating a dry photoresist layer as the top layer, the requirement of removing wax from the microfluidic channels can be eliminated. Therefore, a single vent port can be used at the end of a long microfluidic channel or multiple microfluidic channels can be connected to a single vent port.

In some examples, the microfluidic channels can have a serpentine shape, as shown in FIGS. 1 and 4. The serpentine channels can have multiple turns to allow a great length of microfluidic channel to occupy a small area. In some cases, the turns can be rounded as shown in FIGS. 1 and 4. In other examples, the turns can have sharp angles such as 90° angles, 45° angles, and so on.

Figure 6:
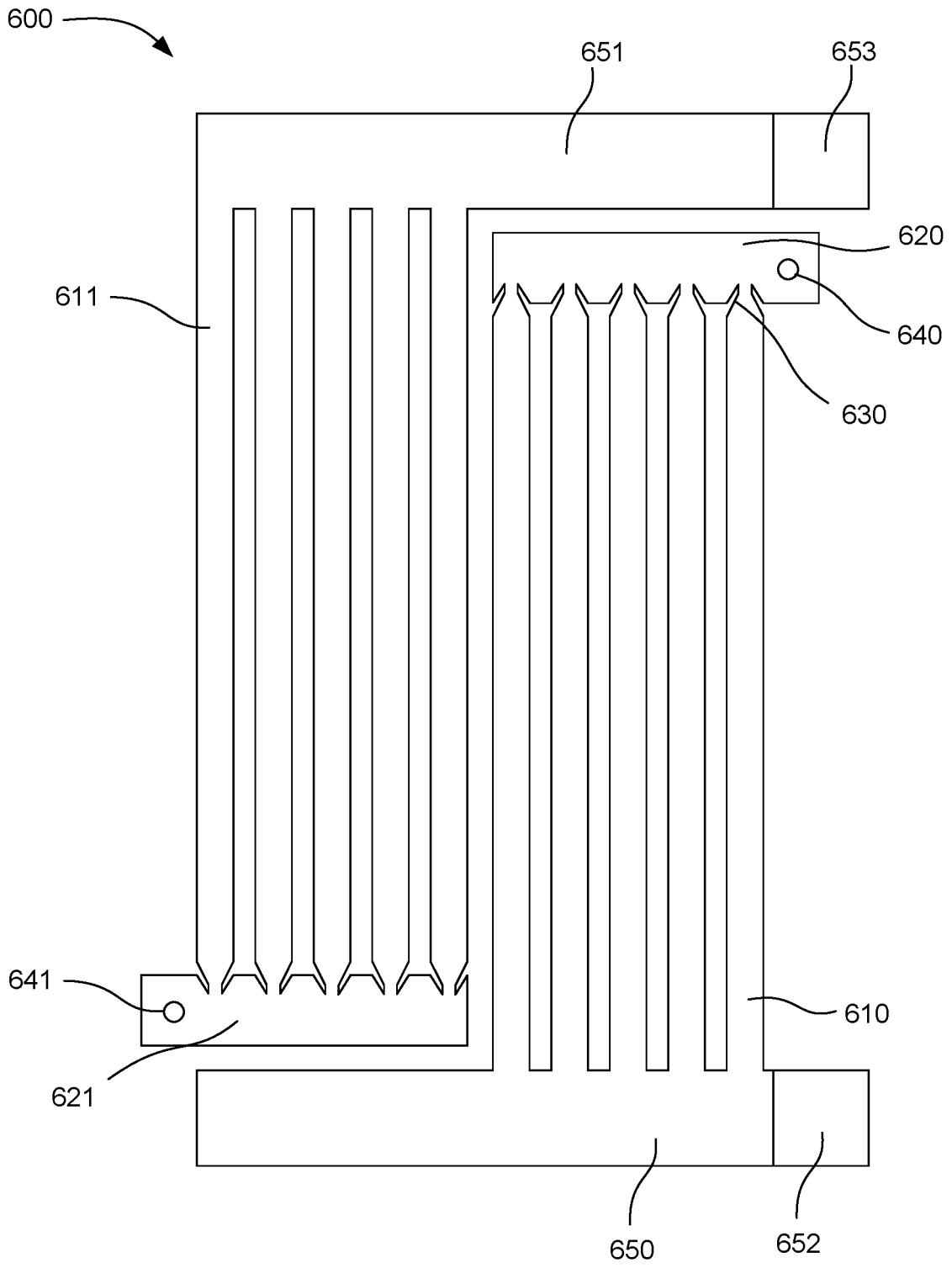
FIG. 6 is a schematic view of an example microfluidic device in accordance with the present disclosure.

Microfluidic devices according to the present technology can also have other layouts. FIG. 6 shows another example of a microfluidic device 600 with a different layout. This device can include first and second covered fluid feed slots 650, 651 with first and second fluid feed holes 652, 653. The covered fluid feed slots can be connected to first and second pluralities of parallel microfluidic channels 610, 611. Each microfluidic channel can lead to a capillary break 630, which separates the microfluidic channels from first and second vent chambers 620, 621. The capillary breaks can prevent fluid from escaping through first and second vent ports 640, 641.

Figure 7:
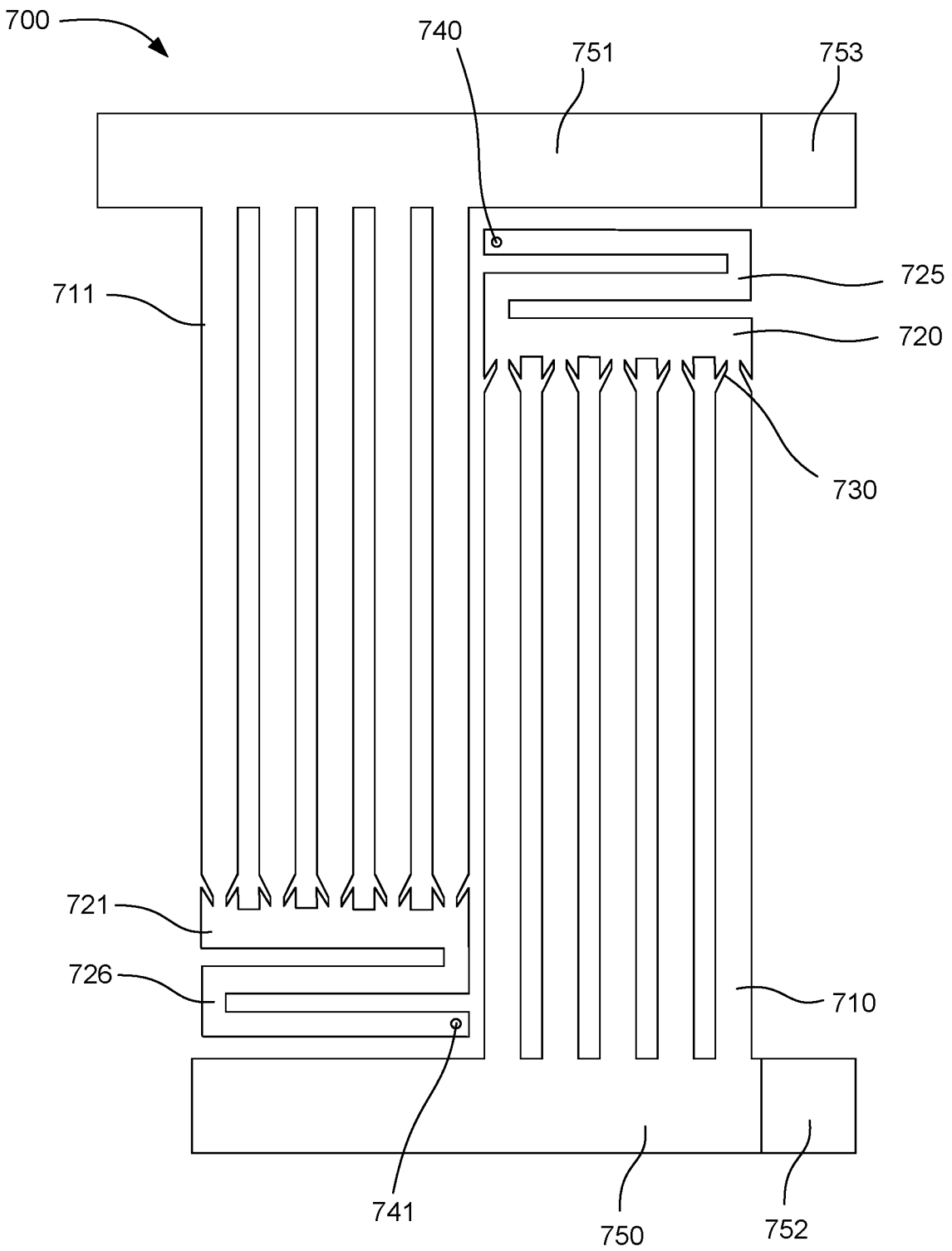
FIG. 7 is a schematic view of an example microfluidic device in accordance with the present disclosure.

FIG. 7 shows an additional example of a microfluidic device 700. This device can include first and second covered fluid feed slots 750, 751 with first and second fluid feed holes 752, 753. The covered fluid feed slots can be connected to first and second pluralities of parallel microfluidic channels 710, 711. Each microfluidic channel can lead to a capillary break 730, which separates the microfluidic channels from first and second vent chambers 720, 721. The capillary breaks can prevent fluid from escaping through first and second vent ports 740, 741. The vent chambers can be separated from the vent ports by first and second vent conduits 725, 726 that lead from the vent chambers to the vent ports. As shown in this figure, in some examples the vent conduits can have one or more turns between the vent chambers and vent ports. Additionally, in some examples the vent conduits can have a width smaller than the width of the microfluidic channels. For example, the vent conduits can have a width from about 2 μm to about 20 μm. In some cases, using vent conduits that can be long and narrow, with one or more turns, can decrease the diffusion of vapor through the vent conduit and out of the vent port by increasing the diffusion length traveled by vapor to leave the device. This can help reduce evaporation of fluid from the device.

In some examples, a microfluidic device can be designed to move fluid through the microfluidic channels solely by capillary force. For example, the covered fluid feed slots and microfluidic channels can be designed so that the microfluidic channels may be self-priming by capillary force. In one example, a microfluidic channel can have a sufficiently small width that the fluid may be drawn into the microfluidic channel by capillary force. The microfluidic channel can be connected to a vent chamber and vent port through a capillary break as explained above, so that the air displaced by the fluid can escape through the vent port, but the fluid will stop at the capillary break.

However, in other examples, the microfluidic device can include inertial pumps to actively move fluids through the microfluidic channels. An inertial pump can include a fluid actuator such as a piezoelectric element or a thermal resistor. The fluid actuator can displace fluid by moving a piezoelectric element or boiling the fluid to form a vapor bubble. The fluid actuator can be placed in a microfluidic channel in a location that may be asymmetric with respect to the length of the microfluidic channel. When the fluid actuator repeatedly displaces fluid, a net flow can be produced in one direction. For example, the fluid actuator can be placed close to the connection between the microfluidic channel and the covered fluid feed slot to produce a net flow of fluid out of the covered fluid feed slot and into the microfluidic channel.

Figure 8:
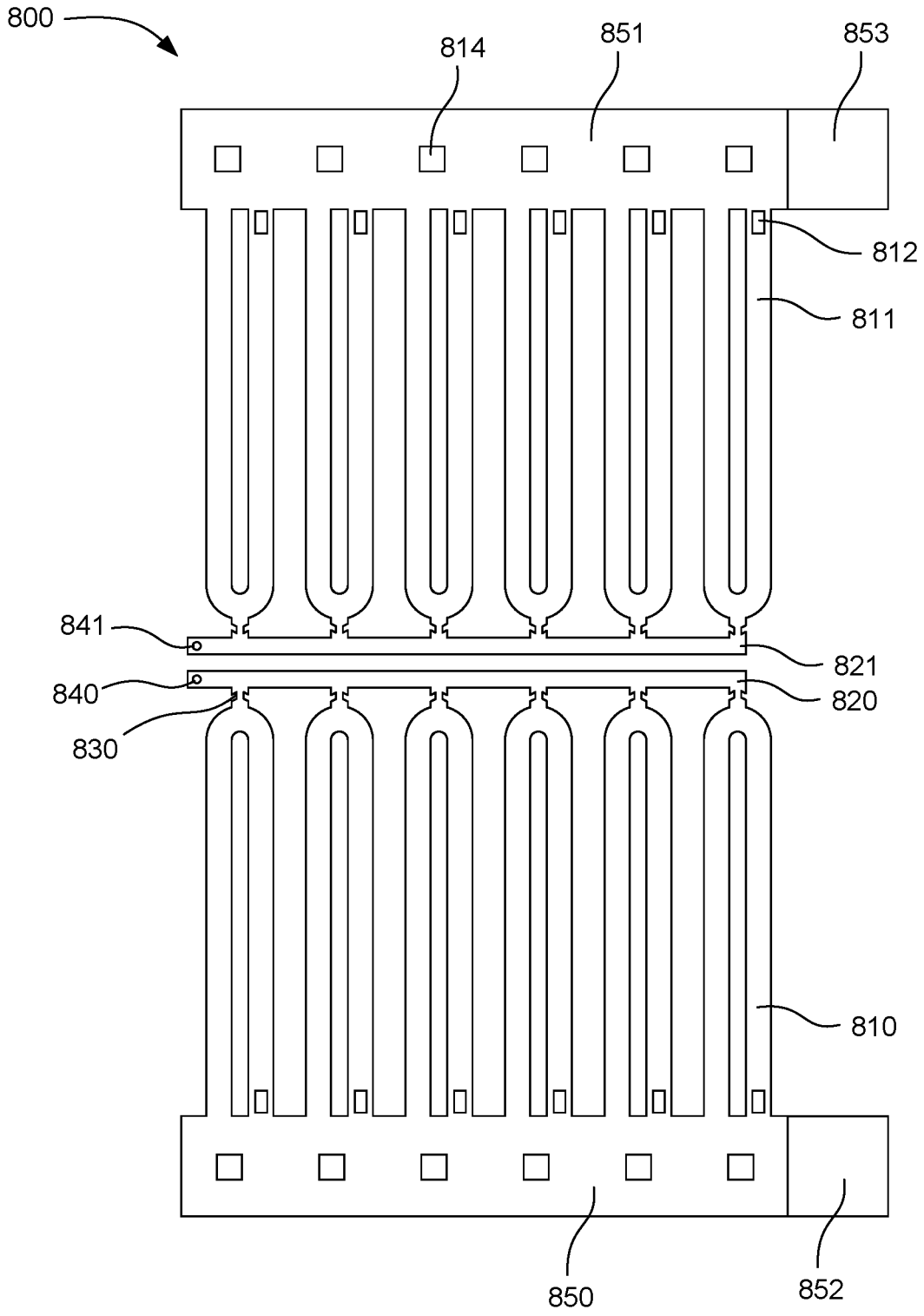
FIG. 8 is a schematic view of an example microfluidic device in accordance with the present disclosure.

FIG. 8 shows yet another example of a microfluidic device 800 with additional features. The device can include first and second covered fluid feed slots 850, 851 with first and second fluid feed holes 852, 853. A first plurality of microfluidic channels 810 can be formed as loops connecting to the first covered fluid feed slot at both ends. A second plurality of microfluidic channels 811 can also be formed as loops connecting to the second covered fluid feed slot at both ends. The microfluidic channels can also be connected to first and second vent chambers 820, 821 through capillary breaks 830. The vent chambers can be in fluid communication with first and second vent ports 840, 841.

The example shown in FIG. 8 also includes resistors 812 in the microfluidic channels. The resistors can form bubbles to displace fluid in the microfluidic channels. Because the resistors can be located asymmetrically with respect to the length of the microfluidic channels, the resistors can create a net fluid flow in one direction and act as inertial pumps. In this example, the resistors can circulate fluid through the loops of the microfluidic channels.

The example shown in FIG. 8 can also include pillars 814 formed in the covered fluid feed slots 810, 820. These pillars can be formed of solid material as a part of the microfluidic layer. The pillars can provide additional support for the top layer over the covered fluid feed slots. When the top layer is formed by laminating a dry photoresist layer instead of using a lost wax method, the pillars can help support the dry photoresist layer during lamination to prevent sagging or breakage of the top layer.

Figure 9:
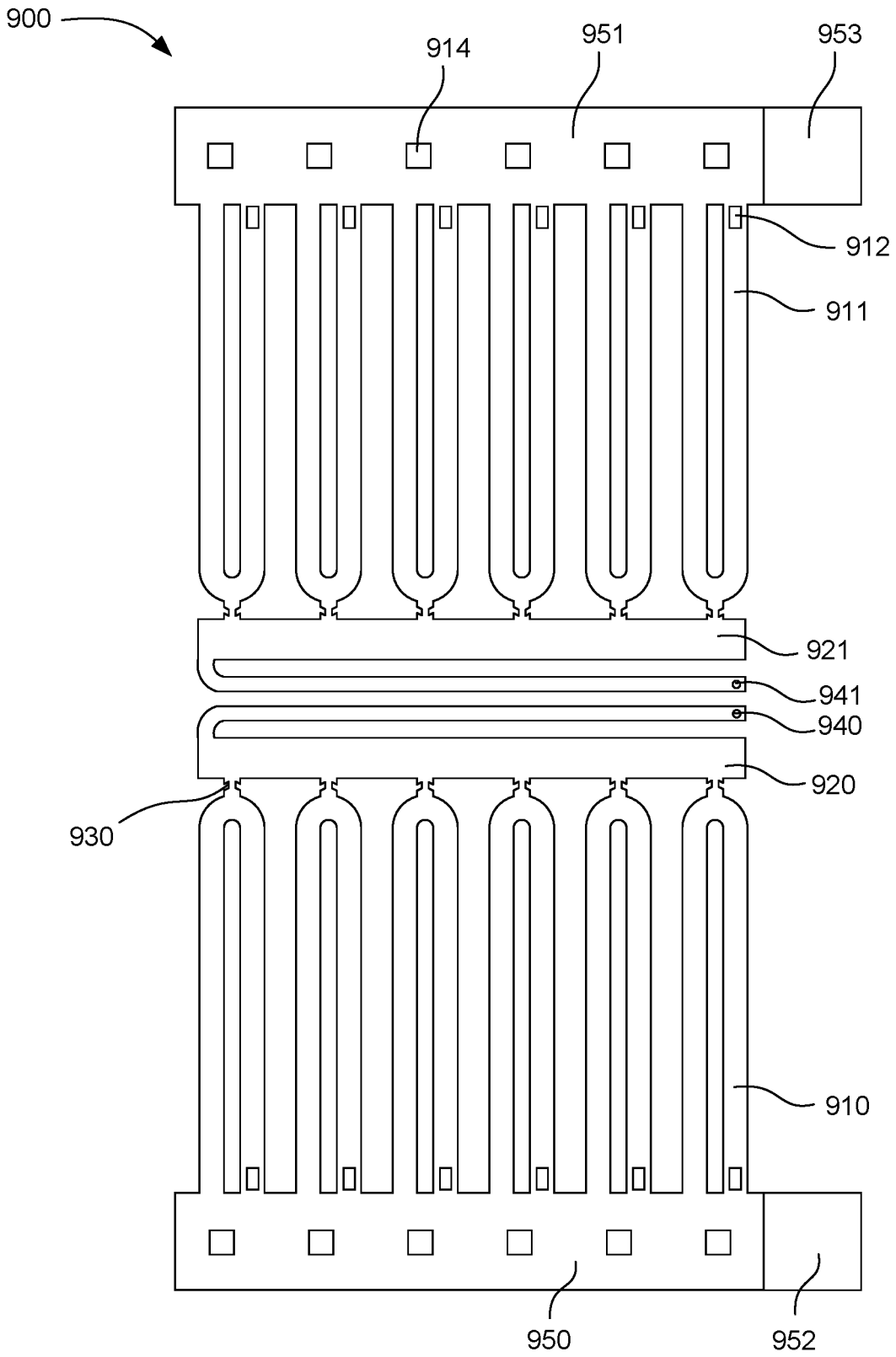
FIG. 9 is a schematic view of an example microfluidic device in accordance with the present disclosure.

FIG. 9 shows a similar example of a microfluidic device 900. The device can include first and second covered fluid feed slots 950, 951 with first and second fluid feed holes 952, 953. The covered fluid feed slots can include pillars 914 to support the top layer. A first plurality of microfluidic channels 910 can be formed as loops connecting to the first covered fluid feed slot at both ends. A second plurality of microfluidic channels 911 can also be formed as loops connecting to the second covered fluid feed slot at both ends. The microfluidic channels can include resistors 912 to function as inertial pumps. The microfluidic channels can also be connected to first and second vent chambers 920, 921 through capillary breaks 930. The vent chambers can be connected to vent conduits 925, 926 that lead to first and second vent ports 940, 941. In this example, the vent chambers can have a width that is greater than a width of the microfluidic channels, while the vent conduits can have a width that is less than the width of the microfluidic channels.

Figure 10:
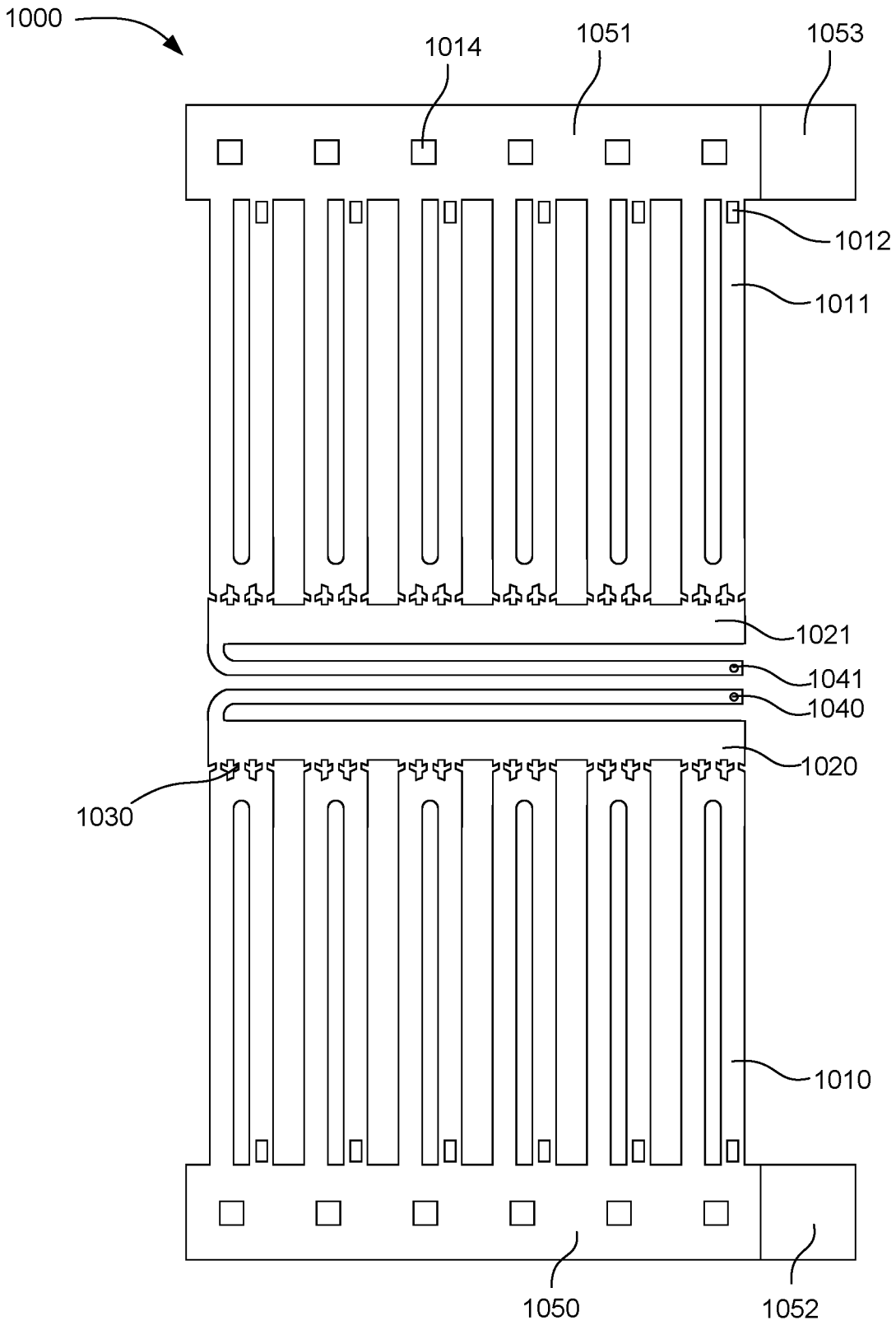
FIG. 10 is a schematic view of an example microfluidic device in accordance with the present disclosure.

In certain examples, a microfluidic channel can connect to the vent chamber through multiple parallel capillary breaks. FIG. 10 shows an example of a microfluidic device 1000 that can include first and second covered fluid feed slots 1050, 1051 with first and second fluid feed holes 1052, 1053. The covered fluid feed slots can include pillars 1014 to support the top layer. A first plurality of microfluidic channels 1010 can be formed as loops connecting to the first covered fluid feed slot at both ends. A second plurality of microfluidic channels 1011 can also be formed as loops connecting to the second covered fluid feed slot at both ends. The microfluidic channels can include resistors 1012 to function as inertial pumps. The microfluidic channels can also be connected to first and second vent chambers 1020, 1021 through capillary breaks 1030. In this example, each loop-shaped microfluidic channel can be connected to the vent chamber through three parallel capillary breaks. The vent chambers can be connected to vent conduits 1025, 1026 that lead to first and second vent ports 1040, 1041

Figure 11:
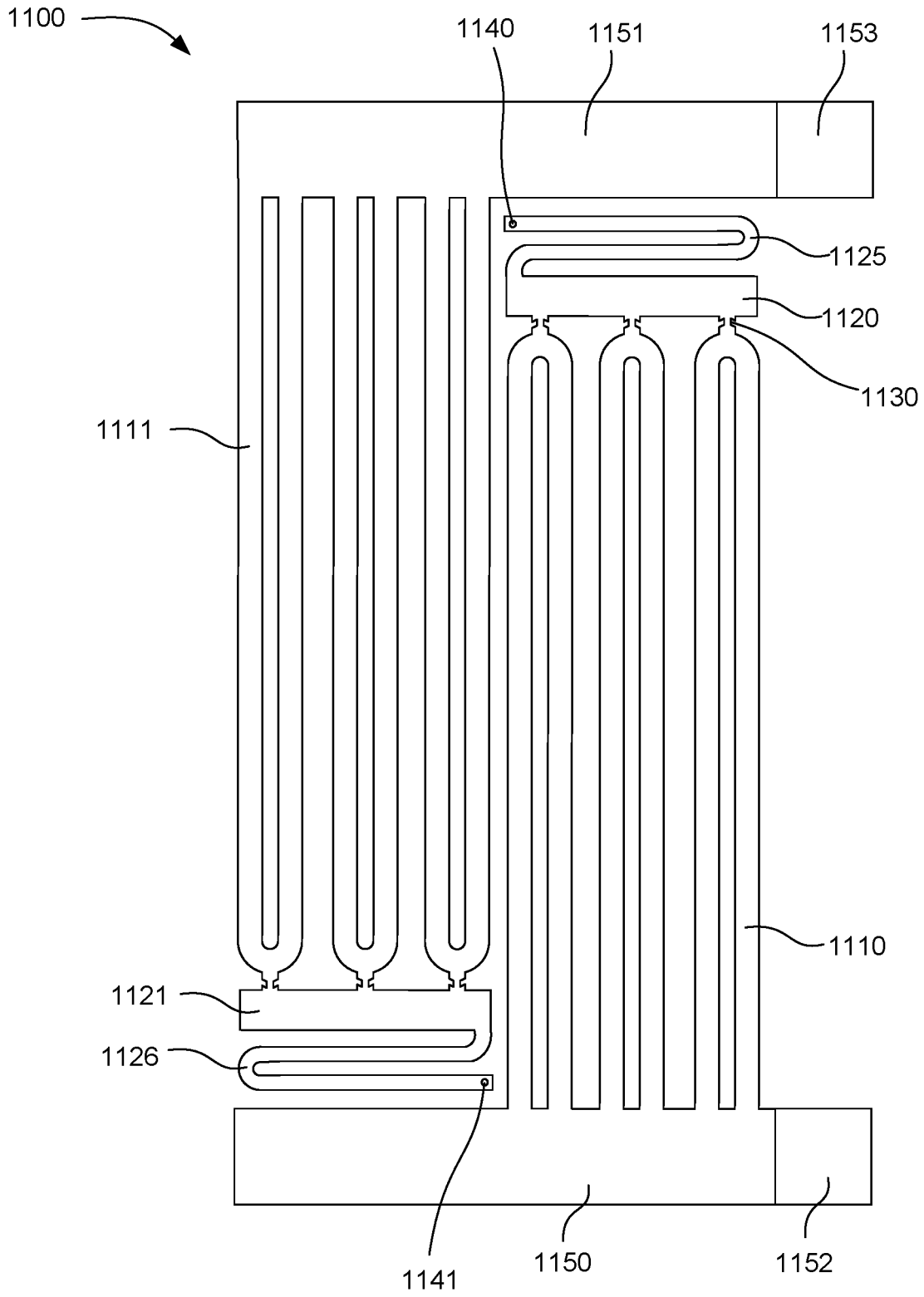
FIG. 11 is a schematic view of an example microfluidic device in accordance with the present disclosure.

FIG. 11 shows another example of a microfluidic device 1100 according to the present technology. The device can include first and second covered fluid feed slots 1150, 1151 with first and second fluid feed holes 1152, 1153. A first plurality of microfluidic channels 1110 can be formed as loops connecting to the first covered fluid feed slot at both ends. A second plurality of microfluidic channels 1111 can also be formed as loops connecting to the second covered fluid feed slot at both ends. The microfluidic channels can also be connected to first and second vent chambers 1120, 1121 through capillary breaks 1130. The vent chambers can be connected to vent conduits 1125, 1126 that lead to first and second vent ports 1140, 1141.

In further examples, any of the designs described above can be adapted for various lengths of covered fluid feed slots. For example, a much longer covered fluid feed slot can be used with multiples of the microfluidic channel designs connected along the length of the covered fluid feed slot. In such examples, a single fluid feed hole can be located at one end of the long covered fluid feed slot. Alternatively, two fluid feed holes can be used, one at each end of the long covered fluid feed slot. Additional fluid feed holes can optionally be added along the length of the covered fluid feed slot if desired.

In various examples, the covered fluid feed slots can range in length from about 100 μm to 50,000 μm or longer. In further examples, the covered fluid feed slots can have widths ranging from 30 μm to 1,000 μm. Shorter covered fluid feed slots can connect to one or a few microfluidic channels. Longer covered fluid feed slots can connect to many more microfluidic channels. In some cases, using a longer covered fluid feed slot with a single fluid feed hole can improve evaporation because only a small amount of fluid evaporates from the single fluid feed hole relative to the larger volume of fluid in the covered fluid feed slot and connecting microfluidic channels. In certain examples, the ratio of the area of the fluid feed hole to the area of the covered fluid feed slot can range from 1:10 to 1:10,000. In further examples, the fluid feed holes can have a length from about 20 μm to about 10,000 μm, and a width from about 20

μm to about 1,000 μm. In more specific examples, the fluid feed holes can have a length from about 20 μm to about 110 μm. The fluid feed holes can also be formed with a variety of shapes, such as square, rectangular, or circular.

Figure 12:
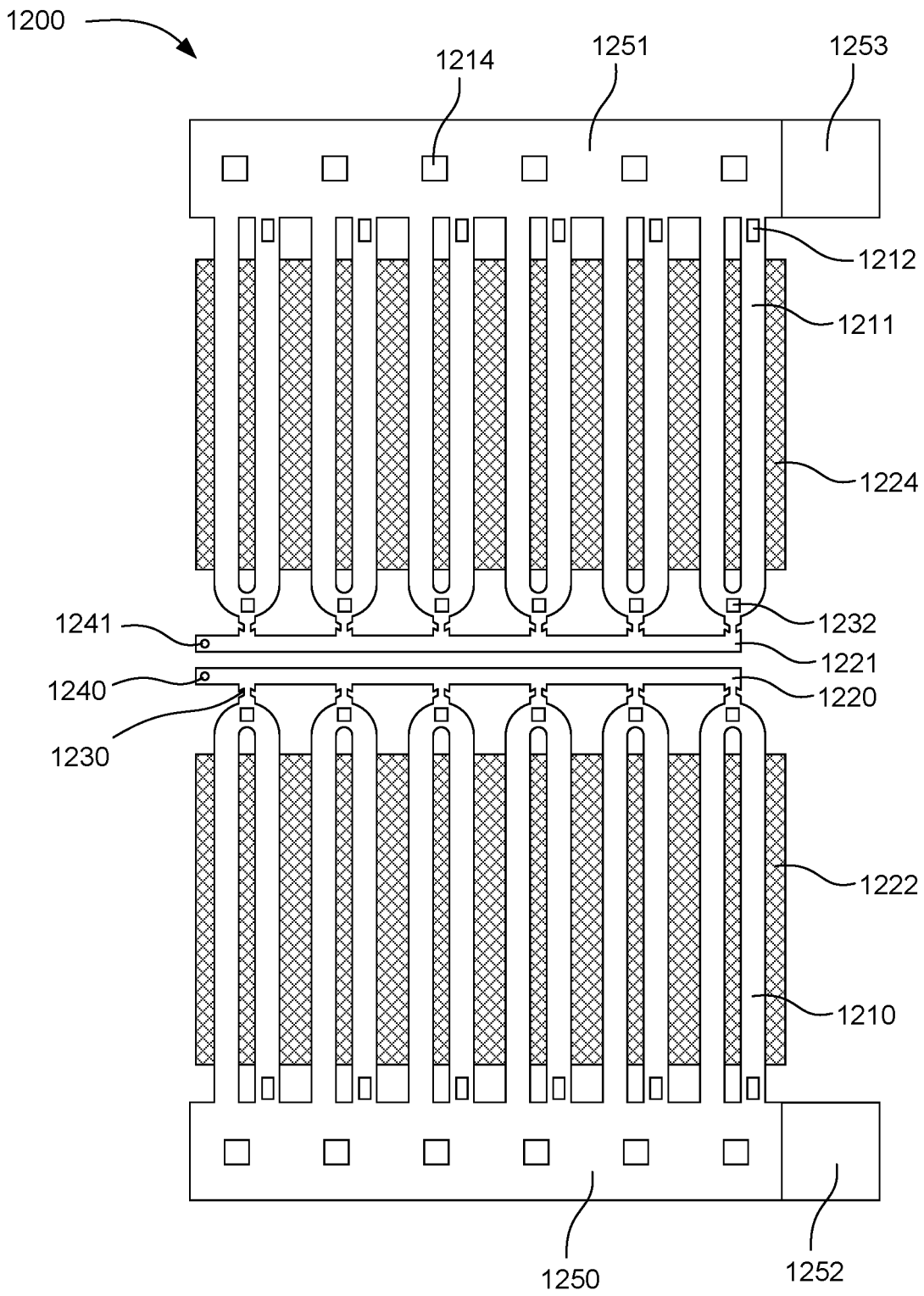
FIG. 12 is a schematic view of an example microfluidic nucleic acid testing device in accordance with the present disclosure.

The microfluidic devices described herein can be used for a variety of applications. In certain examples, the microfluidic devices can be nucleic acid testing devices. FIG. 12 shows an example of a microfluidic nucleic acid testing device 1200. The device can include first and second covered fluid feed slots 1250, 1251 with first and second fluid feed holes 1252, 1253. The covered fluid feed slots can include pillars 1214 to support the top layer. A first plurality of microfluidic channels 1210 can be formed as loops connecting to the first covered fluid feed slot at both ends. A second plurality of microfluidic channels 1211 can also be formed as loops connecting to the second covered fluid feed slot at both ends. The microfluidic channels can include resistors 1212 to act as inertial pumps to circulate fluid through the loops. The microfluidic channels can also be connected to first and second vent chambers 1220, 1221 through capillary breaks 1230. The vent chambers can be in fluid communication with first and second vent ports 1240, 1241 to allow air to escape during priming of the microfluidic channels.

The microfluidic nucleic acid testing device shown in FIG. 12 can also include first and second resistive heaters 1222, 1224 located proximate to the first and second pluralities of microfluidic channels 1210, 1211. In this example, the resistive heaters can be formed on the substrate or primer layer beneath the microfluidic channels. In other examples, the resistive heaters can also be formed above the microfluidic channels, integrated into sidewalls of the microfluidic channels, or located in another location proximate to the microfluidic channels sufficient to heat fluid in the microfluidic channels. The example shown in FIG. 12 can also include temperature sensors 1232 located proximate to the microfluidic channels. The temperature sensors can measure a temperature of fluid in the microfluidic channels. The location of the temperature sensors can be anywhere sufficient to measure the temperature of the fluid in the microfluidic channels. In this example, the temperature sensors can be formed inside the microfluidic channels to be in direct contact with the fluid.

The resistive heaters and temperature sensors can be used in nucleic acid tests that involve elevated temperatures. In some examples, the resistive heaters and temperature sensors can be electronically connected to a processor to control the temperature of the fluid in the microfluidic channels. In one example, the microfluidic nucleic acid testing device can include electrical contacts connected to the resistive heaters and temperature sensors so that a computer can power and control the resistive heaters and temperature sensors through an interface. The computer can also control the inertial pump resistors to circulate fluid through the microfluidic channels.

When performing a nucleic acid test, in some examples a test fluid can be filled into the first covered fluid feed slot and a control fluid can be filled into the second covered fluid feed slot. The test fluid can be a fluid that may contain a specific target DNA sequence, and the control fluid can be a fluid that is not expected to contain the target sequence. The test fluid can be, for example, an aqueous solution of DNA obtained through any suitable DNA extraction method such as lysis of cells or grinding of a sample of a biological organism. The test fluid and control fluid can be subjected to identical conditions in the first and second microfluidic channels. Because the first and second microfluidic channels can be adjacent one to another, it can be easy to compare the test results of the control fluid and the test fluid. For example, in some tests an optical sensor can be used to detect changes in the fluids being tested. A single optical sensor can capture a view of both the test fluid and the control fluid together, so that a direct comparison can be made.

In further examples, the microfluidic device can also be used for multiplexing tests in which a single sample fluid is tested for multiple different targets. In examples involving nucleic acid testing, a first microfluidic channel can be loaded with the sample fluid mixed with a first set of DNA primers and an adjacent channel can be loaded with the sample fluid mixed with a second set of DNA primers. This can be repeated with any number of additional sets of DNA primers in additional channels to simultaneously test the sample fluid for many different target sequences.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, the term "substantial" or "substantially" when used in reference to a quantity or amount of a material, or a specific characteristic thereof, refers to an amount that is sufficient to provide an effect that the material or characteristic was intended to provide. The exact degree of deviation allowable may in some cases depend on the specific context.

As used herein, the term "about" is used to provide flexibility to a numerical range endpoint by providing that a given value may be "a little above" or "a little below" the endpoint. The degree of flexibility of this term can be dictated by the particular variable and determined based on the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

EXAMPLES

The following illustrates an example of the present disclosure. However, it is to be understood that the following are only illustrative of the application of the principles of the present disclosure. Numerous modifications and alternative compositions, methods, and systems may be devised without departing from the spirit and scope of the present disclosure. The appended claims are intended to cover such modifications and arrangements.

Example 1—Microfluidic Nucleic Acid Testing Device

A microfluidic nucleic acid testing device is constructed according to the design shown in FIG. 12. Inertial pump resistors, resistive heaters, and temperature sensors are formed on a silicon substrate. A primer layer of SU-8 photoresist is then spin coated onto the substrate, with a thickness of about 4 μm. A microfluidic layer is formed on the primer layer in two steps. In the first step, a 17 μm thick layer of SU-8 is spin coated onto the primer layer. In the second step, a 14 μm thick dry photoresist layer is laminated onto the previous layer. The dry layer is exposed to a UV pattern of the microfluidic features shown in FIG. 12 and developed by dissolving unexposed portions. The temperature sensors formed on the substrate before applying the primer layer are located so that the temperature sensors can measure the temperature of fluid in the microfluidic channels. A top layer is then formed by laminating a 14 μm thick dry photoresist layer over the microfluidic layer. The top layer is exposed to a UV-light pattern defining the vent ports. The top layer is then developed by dissolving the unexposed portions.

The size and shape of the microfluidic features in the example device are as follows. The microfluidic channels have a width of 30 μm. The microfluidic channels are spaced so that a minimum wall thickness between the channels is 12 μm. The covered fluid feed slots are formed with a width of 110 μm and a length of 1000 μm. The fluid feed holes are 110 μm×110 μm. Support pillars are formed in the covered fluid feed slots with dimensions of 30 μm×30 μm. The capillary breaks have a narrow opening width of 10 μm. The exterior tapering angle of the capillary breaks is 30° and the interior tapering angle is 15°. The vent ports have a diameter of 10 μm.

In an additional example, a microfluidic nucleic acid testing device is constructed by the same process described above but with covered fluid feed slots having a length of 22,200 μm and fluid feed holes with dimensions of 900 μm×110 μm. The pattern of microfluidic channels shown in FIG. 12 is repeated along the length of the covered fluid feed slots.

While the present technology has been described with reference to certain examples, those skilled in the art will appreciate that various modifications, changes, omissions, and substitutions can be made without departing from the spirit of the disclosure. It is intended, therefore, that the disclosure be limited only by the scope of the following claims.

What is claimed is:

1. A microfluidic device, comprising: a microfluidic channel; a vent chamber in fluid communication with the microfluidic channel; a capillary break between the microfluidic channel and the vent chamber, wherein the capillary break comprises a tapered portion and a narrowed opening with a smaller width than a width of the microfluidic channel; and a vent port to vent gas from the vent chamber, wherein the vent port is located a distance away from the capillary break such that a fluid in the capillary break is configured to not escape through the vent port.

2. The microfluidic device of claim 1, wherein the capillary break has a narrowed opening width from about 2 μm to about 20 μm.

3. The microfluidic device of claim 1, wherein the capillary break is one of a plurality of capillary breaks connected in series between the microfluidic channel and the vent chamber.

4. The microfluidic device of claim 3, wherein the microfluidic channel is separated from the vent chamber by three or more capillary breaks connected in series.

5. The microfluidic device of claim 4, wherein the capillary breaks have different narrowed opening widths decreasing in the direction toward the vent chamber.

6. The microfluidic device of claim 1, wherein the microfluidic channel is one of a plurality of microfluidic channels, and wherein the plurality of microfluidic channels is in fluid communication with the vent chamber through a plurality of capillary breaks.

7. The microfluidic device of claim 1, further comprising a vent conduit separating the vent port from the vent chamber, wherein the vent conduit has a width smaller than a width of the microfluidic channel.

8. The microfluidic device of claim 7, wherein the vent conduit includes one or more turns.

9. The microfluidic device of claim 1, wherein the vent port has a diameter from about 2 μm to about 20 μm.

10. The microfluidic device of claim 1, wherein the microfluidic channel is formed as a loop having a turn with the capillary break connecting the microfluidic channel at the turn to the vent chamber.

11. A microfluidic nucleic acid testing device, comprising: a fluid feed opening; a microfluidic channel in fluid communication with the fluid feed opening; a vent chamber in fluid communication with the microfluidic channel; a heating resistor located proximate to the microfluidic channel capable of heating a fluid in the microfluidic channel; a capillary break between the microfluidic channel and the vent chamber, wherein the capillary break comprises a tapered portion and a narrowed opening with a smaller width than a width of the microfluidic channel; and a vent port to vent gas from the vent chamber, wherein the vent port is located a distance away from the capillary break such that a fluid in the capillary break is configured to not escape through the vent port.

12. The microfluidic nucleic acid testing device of claim 11, further comprising a temperature sensor located proximate to the microfluidic channel capable of measuring a temperature of a fluid in the microfluidic channel.

13. The microfluidic nucleic acid testing device of claim 11, wherein the microfluidic channel is capable of self-priming by capillary force.

14. A microfluidic device, comprising: a covered fluid feed slot including a fluid feed hole for filling a fluid into the covered fluid feed slot, the fluid feed hole having a smaller area than the covered fluid feed slot; a plurality of microfluidic channels formed as loops connecting to the covered fluid feed slot at both ends; inertial pumps in the microfluidic channels to circulate fluid through the microfluidic channels; a vent chamber in fluid communication with the plurality of microfluidic channels; a plurality of capillary breaks between the plurality of microfluidic channels and the vent chamber, wherein the capillary breaks comprise a tapered portion and a narrowed opening with a smaller width than a width of the microfluidic channels; and a vent port to vent gas from the vent chamber, wherein the vent port is located a distance away from the capillary breaks such that a fluid in the capillary breaks is configured to not escape through the vent port.

15. The microfluidic device of claim 14, wherein each microfluidic channel is separated from the vent chamber by three or more capillary breaks connected in series.

* * * * *